United States Patent [19]

Klemm

[11] 4,023,917

[45] May 17, 1977

[54] ROTARY PISTON ENGINE

[76] Inventor: Wolf Klemm, Wiesenweg 4, 8023 Pullach, Germany

[22] Filed: Oct. 28, 1975

[21] Appl. No.: 625,865

[52] U.S. Cl. ..... 418/191
[51] Int. Cl.[2] ..... F01C 1/08
[58] Field of Search ..... 91/197; 418/191; 123/8.47

[56] References Cited

UNITED STATES PATENTS

| | | | |
|---|---|---|---|
| 3,218,984 | 11/1965 | Mosovsky | 418/191 X |
| 3,237,613 | 3/1966 | Mosovsky | 418/191 X |
| 3,353,519 | 11/1967 | Reichart | 418/191 X |

FOREIGN PATENTS OR APPLICATIONS

| | | | |
|---|---|---|---|
| 354,882 | 8/1931 | United Kingdom | 123/8.47 |

*Primary Examiner*—Carlton R. Croyle
*Assistant Examiner*—Michael Koczo, Jr.
*Attorney, Agent, or Firm*—Otto John Munz

[57] ABSTRACT

A cylinder wheel member having a plurality of cylinder cavities is in meshing engagement with a piston wheel member having a plurality of piston elements between which segment-like cavities are provided. The meshing engagement of said wheel members provides expanding and contracting working chambers in the cylinder cavities of said cylinder wheel member as well as in the segment-like cavities of said piston wheel member. A disc-like commutator valve rigidly connected to said piston wheel member has two types of through passages, the first type of which connects the working chambers in said cylinder cavities of the cylinder wheel member to fluid inlet and outlet means of a casing rotatably supporting said wheel members and the second type of which connects the working chambers both in said cylinder cavities of the cylinder wheel member and in the segment-like cavities of said piston wheel member to said inlet and outlet means for a fluid. Thus, on both sides of the piston elements projecting into the cylinder cavities impulses are generated to drive one of said wheel members connected to a driving shaft.

4 Claims, 8 Drawing Figures

Fig. 1
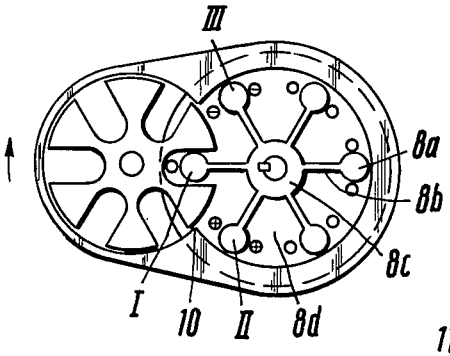
Fig. 2
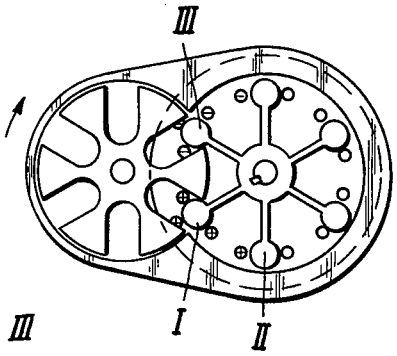
Fig. 3
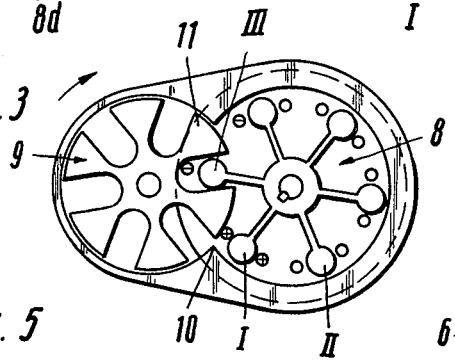
Fig. 4
Fig. 5
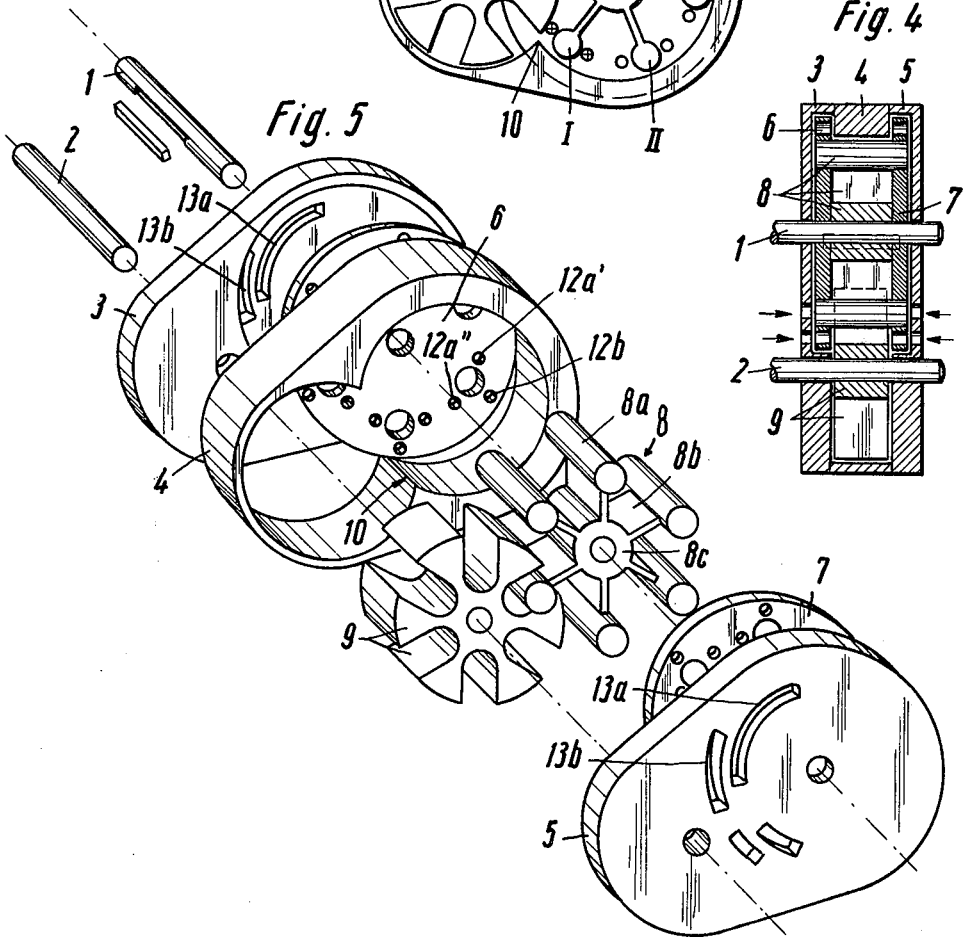

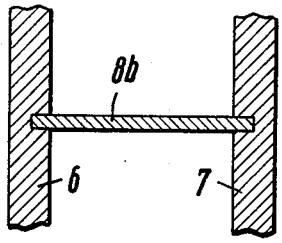
Fig. 6
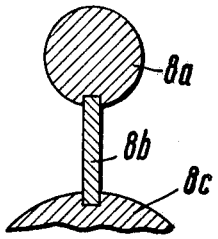
Fig. 7
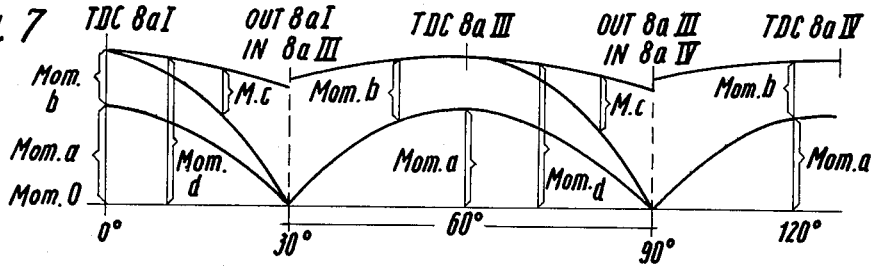
Fig. 8
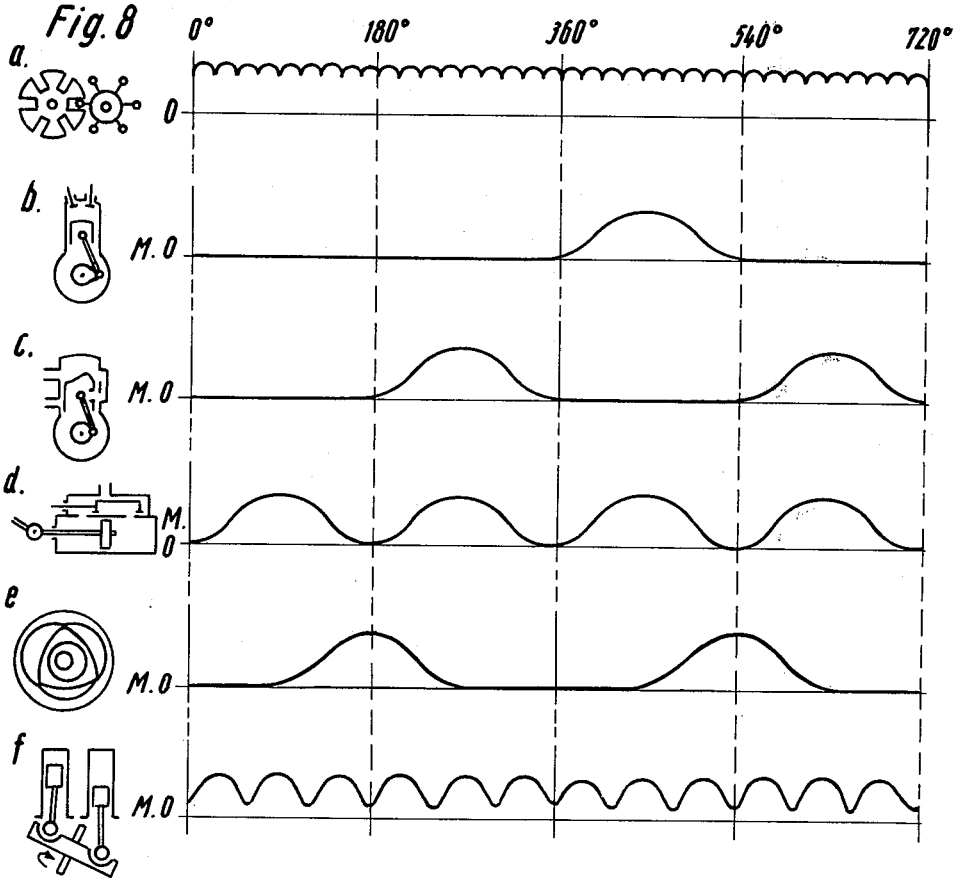

ROTARY PISTON ENGINE

STATE OF THE KNOWN ART

Piston machines or piston engines whose operation is based on the action of gas, liquid or vapour pressure are known; piston machines whose pistons and cylinders rotate are also known. Common to all these machines is that they operate with pistons which once they have reached their top dead center (TDC) in the cylinder are forced out of this position again by means of pressure generation in the cylinder and then start to return to the TDC again.

The stroke movements of the pistons are converted mechanically to rotary movements which are taken from a shaft. In known piston machines according to the mode of operation, per "piston-cylinder unit" only the following force impulses are effective at the shaft:

In a four-stroke engine 1 impulse for 2 shaft revolutions;

in a two-stroke engine 1 impulse for 1 shaft revolution;

in double-action steam or diesel engines 2 impulses for 1 shaft revolution;

in a rotary piston (Wankel) engine 7 impulses for 1 shaft revolution;

in axial or gear engines 1 impulse per piston and revolution.

Furthermore, although the production of reciprocating piston machines is relatively simple, great difficulties are encountered in the production of hitherto known rotary piston and gear engines.

Summarizing, firstly with the hitherto known machines and engines per "piston-cylinder unit" in all cases only one impulse is effected which occurs in the cylinder chamber itself. No impulse is generated externally of the cylinder.

Secondly, the production of rotary piston or piston star machines was hitherto very complicated and expensive.

Thirdly, since the aforementioned machines or engines lend themselves very poorly to the module construction principle for different power ranges engines of different size with different part dimensions must be built.

SUMMARY OF THE INVENTION

The object of the present invention is therefore to provide engines whose "piston-cylinder units" each produce a plurality of force impulses per unit and revolution; this results in a high number of force impulses per revolution on the take-off shaft; the engines are moreover so designed that they are simple and economical to produce and furthermore can in simple manner be arranged in series so that only one basic type is necessary to cover different power ranges employing the module principle.

DETAIL DISCUSSION

With the type of engine according to the present invention as here described 3 force impulses per "piston-cylinder unit" and revolution are effective, i.e., with a six-piston engine $6 \times 3 = 18$ impulses/shaft revolution; in addition, the structure and manufacture thereof are very simple and suitable for the module principle.

This drive system may be used for steam or vapour engines, fluid engines and gas-pressure engines as well as for internal combustion engines and it differs from the systems hitherto known primarily in that the force impulses are produced not only in the cylinder itself but by means of suitable valve arrangements also in the working chambers externally of the cylinder in the so-called "piston star chambers **8*d***".

These and other features of the invention will be more clearly understood from the following detailed description with the aid of the drawings of one embodiment of the present invention representing a "hydrostatic motor" having six pistons and two valve discs; the embodiment described is only one of the large number of possible embodiments. In the drawings:

FIGS. 1, 2 and 3 show the mode of operation.

FIG. 4 shows a section in the plane of the shafts 1 and 2.

FIG. 5 shows isometrically the main components of the engine.

FIG. 6 is an enlarged sectional detail of the piston wheel of a preferred embodiment:

FIG. 7 is a diagram showing the rates and types of the several momentums developed by the engine of this invention: and FIG. 8, including sections *a* through *f*, is a view representing to scale the impuses developed by the engine of the invention as compared with engines of five (5) other types.

The left, center and right housing portions are denoted by 3, 4 and 5 respectively. 6 and 7 denote the left and right valve discs and 8 is the piston star. **8*a* denotes the pistons, 8*b* the chamber partitions and 8*c* the piston star hub. The piston star chambers are denoted by 8*d* and the cylinder star by 9 whilst 10 and 11 are the lower and upper overlapping edges respectively. The inner valve openings are denoted by 12*a*' and 12*a*'' and the outer valve openings by 12*b*. 13*a* and 13*b* are the inner and outer valve slots and 1 and 2** denote the piston star shaft and the cylinder star shaft respectively.

In this embodiment the valve openings **12*a*', 12*a*'' and 12*b* in the valve discs 6 and 7 are circular bores and the valve slots 13*a* and 13*b* in the housing portions 3 and 5** are arcuate slots.

All these members are easy to manufacture and assemble.

With the construction of the piston star 8 according to the embodiment illustrated the forces acting on the pistons **8*a* are transmitted to the two valve discs 6 and 7 and from the latter to the hub 8*c* and shaft 1**.

An alternative example of the force transmission is shown in FIG. 7 wherein the chamber partitions **8*b***, let all round into grooves, transmit the piston forces via the valve discs to the hub and shaft.

The valve discs 6 and 7 also act as rotary valves. They have a larger diameter than the piston star itself; this makes it possible to provide the valve openings **12*b* in the disc areas outside the piston star and the orbits of said openings coincide with the valve slots 13*b*. Furthermore, in the valve discs 6 and 7 the two valve openings 12*a*' and 12*a*'' are associated with each piston 8*a* and their orbits coincide with the valve slots 13*a*. The distance apart of the inner surfaces of the two valve discs 6 and 7 is exactly equal to the internal width of the housing member 4. To achieve this the housing parts 3 and 5 are provided with circular recesses which accommodate the valve discs 6 and 7 (FIGS. 4 and 5**).

The mode of operation of the embodiment described is as follows: Due to the rotary movements the valve openings **12*a* and 12*b*** are alternately "opened" and "closed". Hydraulic fluid thus enters at this instant through the "open" valve openings denoted by "plus" in FIGS. 1, 2 and 3. The fluid leaves again through the likewise "open" valves, designated by "minus". Valves not designated by a + or − are to be considered as "closed".

If a clock face were projected onto FIGS. 1, 2 and 3 the piston 8*a*I in FIG. 1 would be at 9 o'clock, the piston 8*a*II at 7 o'clock and the piston 8*a*III at 11 o'clock.

In FIG. 1 the piston 8*a*I in this position has just reached the top dead center in the cylinder; the valve 12*b* which can be seen in the cylinder chamber above the piston 8*a*I is closed; the valves 12′ and 12″ belonging to the piston 8*a*I are covered and thus closed. On the other hand, the valve 12*a*″ of the piston 8*a*II is open; fluid flows into the piston star chamber 8*d* disposed between the pistons 8*a*I and 8*a*II and with the impulses $a + b$ effects a rotary movement of the system.

FIG. 2 shows the situation which the piston 8*a*I has meanwhile reached in its cylinder chamber as a result of this rotary movement: Not only the valve 12*b* belonging to this piston 8*a*I has been opened but also the associated valves 12*a*′ and 12*a*″. Fluid now flows through the valves 12*b* and 12*a*″ into the cylinder chamber and forces the piston 8*a*I out. This piston movement is the 3rd impulse the impulse *c*, which is effective as a rotary force at the shaft 1. This operation is supported by the fluid which simultaneously flows through the valve 12*a*′ of the piston 8*a*I into the chamber between the piston 8*a*I and the piston 8*a*II and accelerates the chamber filling.

As the cycle continues the piston 8*a*I is pushed completely out of its cylinder chamber and in FIG. 3 reaches the position 7 o'clock. The valve 12*b* of the piston 8*a*I thereby closes but the fluid now flows through the valve 12*a*′ of the piston 8*a*I into the chamber 8*d* which lies between the pistons 8*a*I and 8*a*III and brings about the condition already illustrated in FIG. 1. The impulse sequence thus begins again with the impulses $a + b$ for the next piston star sector lying between the pistons 8*a*I and 8*a*III.

It is apparent from the foregoing that during one 1/6 revolution of the shaft 1 three force impulses are effective and thus for one complete revolution of the shaft 1 through 360° the number of impulses is $6 \times 3 = 18$.

As regards the torque, it is apparent from FIGS. 1, 2, 3 and 7 that the individual impulses overlap in such a manner that the stationary motor begins to run as soon as fluid begins to flow. The torques vary as follows (cf. also FIG. 7): In FIG. 1 the piston 8*a*I is at TDC. In this position the mechanical moment obtaining is made up of two impulses: The 1st impulse is impulse *a*: A chord drawn from the lower line of contact between the piston 8*a*I and the cylinder wall to the lower overlapping edge 10 is the length of the effective area on which the fluid pressure acts and thus tends to displace the portion of the cylinder star 9 projecting into the piston star chamber 8*d*. The resultant force passes beneath the cylinder star axis 2 and the distance is the leverage. This moment turns the cyliner star 9 in the clockwise direction and is thereby transmitted to the piston 8*a*I by the upper wall of the cylinder chamber. On futher rotation the effective area becomes smaller but the leverage greater due to the change in the angle and consequently this impulse *a* only gradually approaches zero.

The second impulse is impulse *b*: Said impulse *b* comes directly from the piston star 8 and is superimposed on the first impulse *a*. For the area on which the oil pressure acts in the piston star chamber 8*d* between the pistons 8*a*I and 8*a*II is in the case of the piston 8*a*II (= piston star width times (length of the chamber partition 8*b* + diameter of the piston 8*a*II)) greater than the opposite area in the case of the piston 8*a*I (in the latter only piston star width times (length of the chamber wall 8*b* +½ diameter of the piston 8*a*I)). This area difference (= ½ piston diameter times piston star width) times the leverage (= piston star radius minus ½ piston radius) supplies the impulse *b* which on further rotation approaches zero linearly (emergence of the piston 8*a*I from the cylinder, FIG. 2).

The 3rd impulse is the impulse *c*: The latter occurs due to the displacement of the piston 8*a*I out of the cylinder chamber; it increases linearly as a sinusoidal function and ends when the piston leaves the cylinder chamber. In FIG. 2 the piston 8*a*I is just leaving the chamber and the piston 8*a*III is just entering the following cylinder chamber. The moment now obtaining for the piston 8*a*I is practically the entire pistion area 8*a*I times the distance hub center / piston center times pressure because the corresponding counter area of the piston 8*a*III is covered by the cylinder star.

In the further course of the rotation the line of contact between the piston 8*a*III and the cylinder wall moves outwardly and the area difference and moment thus becomes smaller; however, at the same time the impulse *a* already described in FIG. 1 again increases so that due to the continuous overlapping of the impulses $a + b + c$ on further rotation the curve of the moment illustrated qualitatively in FIG. 7 results.

Start = piston 8*a*I at the TDC = 9 o'clock;

Moment *a* = displacement of the cylinder star out of the piston star;

Moment *b* = area difference of the covered piston and freely preceding piston;

Moment *c* = displacement of piston from cylinder;

moment *d* = total moment = $\epsilon a + b + c$.

As regards forward and rearward running, the engine operates equally in both directions of rotation because the valve openings and valve slots are fully symmetrical and consequently the same but opposite force impulses occur in the two directions of flow.

As regards controllability, the forward and reverse running and the speed regulation may be effected by means of a simple control valve which in the positions "forward", "reverse" and "stop" correspondingly deflects or regulates the oil flow.

In conjunction with FIG. 9, FIG. 7 shows the different variation of the moment with respect in each case to the smallest possible engine unit and two complete revolutions of the takeoff shaft:

FIG. 8*a* = moment graph for "rotary piston engine" according to the invention;

FIG. 8*b* = moment graph for four-stroke engine, single cylinder;

FIG. 8*c* = moment graph for two-stroke engine, single cylinder;

FIG. 8*d* = moment graph for steam engine, single cylinder;

FIG. 8*e* = moment graph for rotary piston engine, single disked;

FIG. 8*f* = moment graph for axial piston engine, 6 cylinder.

While this invention has been described in detail with reference to particular embodiments thereof it will be understood that variations and modifications can be effected within the spirit and scope of the invention as described hereinbefore and as defined in the appended claims.

What I claim is:

1. A rotary piston engine comprising a casing having inlet means and outlet means for an operating fluid, such as gas, steam and liquid, at least one cylinder wheel member having a plurality of cylinder cavities equally spaced in angular relationship, and at least one piston wheel member having a plurality of piston elements arranged on the outer ends of radially extending protrusions defining segment-like cavities between each other, said wheel members being rotatably mounted in said casing by means of shafts and being in meshing engagement such that expanding and contracting working chambers are generated in said cylinder cavities of said cylinder wheel member as well as in said segment-like cavities of said piston wheel member, said piston wheel member having at least a disc-like commutator valve rigidly connected thereto, said disc-like commutator valve having two types of through passages, the first type of which connects said inlet and outlet means of said casing to the working chambers in said cylinder cavities of said cylinder wheel member and the second type of which connects said inlet and outlet means to the working chambers in both the cylinder cavities of said cylinder wheel member and the segment-like cavities of said piston wheel member in dependence upon the angular position of said wheel elements to exert driving impulses on said wheel members on both sides of said piston elements projecting into said cylinder cavities, said inlet means being connected to expanding working chambers and said outlet means being connected to contracting working chambers.

2. A rotary piston engine according to claim 1, wherein said piston wheel member comprises a hub, radially extending partition walls forming said radially extending protrusions, axially extending rollers forming said piston elements and at least one disc forming said disc-like commutator valve, the above mentioned elements of said piston wheel member being rigidly and sealingly connected to each other.

3. A rotary piston engine according to claim 1, wherein said first type of said through passages in said commutator valve each comprises an opening lying radially outwardly of each said piston element and wherein said second type of said through passages comprises two openings arranged adjacent to both sides of each said piston element, whereby said first type openings are arranged along a first circle and said second type openings are arranged along a concentric second circle having a smaller diameter than the first circle.

4. A rotary piston engine according to claim 1, wherein said inlet and outlet means are passages arranged in said casing along a part of the circles described by said through passages of said disc-like commutator valve.

* * * * *

UNITED STATES PATENT OFFICE

CERTIFICATE OF CORRECTION

Patent No. 4,023,917 Dated May 17, 1977

Inventor(s) Wolf Klemm

It is certified that error appears in the above-identified patent and that said Letters Patent are hereby corrected as shown below:

On the Title Page, Item [30] should read:

--- Germany P 24 51 325.5 October 29, 1974 ---.

Signed and Sealed this nineteenth Day of July 1977

[SEAL]

*Attest:*

RUTH C. MASON
*Attesting Officer*

C. MARSHALL DANN
*Commissioner of Patents and Trademarks*